US011840748B2

(12) United States Patent
Arayama

(10) Patent No.: US 11,840,748 B2
(45) Date of Patent: Dec. 12, 2023

(54) ALUMINUM ALLOY FORGING

(71) Applicant: SHOWA DENKO K.K., Tokyo (JP)

(72) Inventor: Takuya Arayama, Kitakata (JP)

(73) Assignee: RESONAC CORPORATION, Tokyo (JP)

( * ) Notice: Subject to any disclaimer, the term of this patent is extended or adjusted under 35 U.S.C. 154(b) by 0 days.

(21) Appl. No.: 18/086,088

(22) Filed: Dec. 21, 2022

(65) Prior Publication Data

US 2023/0203623 A1 Jun. 29, 2023

(30) Foreign Application Priority Data

Dec. 23, 2021 (JP) ..... 2021-209929

(51) Int. Cl.
*C22C 21/02* (2006.01)

(52) U.S. Cl.
CPC ..... *C22C 21/02* (2013.01); *C22C 2200/00* (2013.01)

(58) Field of Classification Search
CPC ..... C22C 21/02; C22C 21/06; C22C 21/12; C22F 1/043; C22F 1/047; C22F 1/057
See application file for complete search history.

(56) References Cited

FOREIGN PATENT DOCUMENTS

| | | |
|---|---|---|
| JP | 05-059477 A | 3/1993 |
| JP | 05-247574 A | 9/1993 |
| JP | 06-256880 A | 9/1994 |

*Primary Examiner* — Jessee R Roe
(74) *Attorney, Agent, or Firm* — Sughrue Mion, PLLC

(57) ABSTRACT

An aluminum alloy forging includes 0.30 mass % or more and 1.0 mass % or less of Cu; 0.63 mass % or more and 1.30 mass % or less of Mg; 0.45 mass % or more and 1.45 mass % or less of Si; the balance being Al and inevitable impurities, wherein the following relations are satisfied, $$[\text{Mg content}]\times 1.587 \geq -4.1\times[\text{Cu content}]^2+7.8\times[\text{Cu content}]-1.9 \quad (1)$$

$$[\text{Si content}]\times 2.730 \geq -4.1\times[\text{Cu content}]^2+7.8\times[\text{Cu content}]-1.9 \quad (2)$$

and the ratio of the integrated intensity Q1 of the X-ray diffraction peak of the $CuAl_2$ phase to the integrated intensity Q2 of the X-ray diffraction peak of the (200) plane of the Al phase obtained by the X-ray diffraction method, Q1/Q2, is $2\times10^{-1}$ or less.

20 Claims, 3 Drawing Sheets

ALUMINUM ALLOY FORGING

Priority is claimed on Japanese Patent Application No. 2021-209929, filed Dec. 23, 2021, the content of which is incorporated herein by reference.

BACKGROUND OF THE INVENTION

Field of the Invention

The present disclosure relates to an aluminum alloy forging.

Description of Related Art

In recent years, aluminum alloys have been increasingly used as structural members in various products because of their light weight. For example, in the past, high-strength steel has been used for underbody parts and bumpers of automobiles, but in recent years, high-strength aluminum alloy materials have been used. While automotive parts, for example, suspension parts, have been exclusively made of iron-based materials, they have increasingly been replaced with aluminum materials or aluminum alloy materials mainly for the purpose of weight reduction.

As these automotive parts require excellent corrosion resistance, high strength and excellent workability, Al—Mg—Si-based alloys, especially A6061, are often used as aluminum alloy materials. In order to improve the strength of such automotive parts, aluminum alloy material is used as a processing material and manufactured by forging, one of the plastic processes.

Further, since it is required to reduce the cost, suspension parts obtained by subjecting a casting member as a raw material to a forging process as it is without performing extrusion and then subjecting the forged product to a T6 treatment have recently begun to be put into practical use. For further weight reduction, the development of high-strength alloys to be replaced with conventional A6061 aluminum alloys has been progressed (see Patent Literatures 1 to 3 listed below).

In recent years, the demand for aluminum is on the rise, as automobile weight reduction is required from the viewpoint of reducing $CO_2$ emissions. However, as an alternative to steel materials, further enhancement of strength is required. Addition of Cu is known as one technique for increasing the strength. However, since the addition of Cu lowers the corrosion resistance, it has not been possible to add a large amount of Cu.

The present invention has been made in view of the aforementioned circumstances and aims to provide aluminum alloy forgings with excellent mechanical properties and corrosion resistance at normal temperature.

PATENT LITERATURES

[Patent Literature 1] Japanese Unexamined Patent Application, First Publication No. H05-59477

[Patent Literature 2] Japanese Unexamined Patent Application, First Publication No. H05-247574

[Patent Literature 1] Japanese Unexamined Patent Application, First Publication No. H06-256880

SUMMARY OF THE INVENTION

The present disclosure provides the following means.

An aspect of the present disclosure provides an aluminum alloy forging including 0.3 mass % or more and 1.0 mass % or less of Cu; 0.63 mass % or more and 1.30 mass % or less of Mg; 0.45 mass % or more and 1.45 mass % or less of Si; the balance being Al and inevitable impurities, wherein the following relations are satisfied, $$[\text{Mg content}]\times 1.587 \geq -4.1\times[\text{Cu content}]^2+7.8\times[\text{Cu content}]-1.9 \quad (1)$$

$$[\text{Si content}]\times 2.730 \geq -4.1\times[\text{Cu content}]^2+7.8\times[\text{Cu content}]-1.9 \quad (2)$$

and the ratio of the integrated intensity Q1 of the X-ray diffraction peak of the $CuAl_2$ phase to the integrated intensity Q2 of the X-ray diffraction peak of the (200) plane of the Al phase obtained by the X-ray diffraction method, Q1/Q2, is $2\times10^{-1}$ or less.

In the aluminum alloy forging according to the above aspect, the content of Mg may be 0.63 mass % or more and 1.25 mass % or less, the content of Si may be 0.60 mass % or more and 1.45 mass % or less, and the ratio of the content of Si to the content of Mg, Si/Mg, may be 0.5 or more in the molar ratio.

In the aluminum alloy forging according to the above aspect, the content of Mg may be 0.85 mass % or more and 1.30 mass % or less, the content of Si may be 0.45 mass % or more and 0.69 mass % or less, and the ratio of the content of Si to the content of Mg, Si/Mg, may be less than 0.5 in the molar ratio.

In the aluminum alloy forging according to the above aspect, the content of Mn may be 0.03 mass % or more and 1.0 mass % or less, the content of Fe may be 0.2 mass % or more and 0.7 mass % or less, the content of Cr may be 0.03 mass % or more and 0.4 mass % or less, the content of Ti may be 0.012 mass % or more and 0.035 mass % or less, the content of B may be 0.001 mass % or more and 0.03 mass % or less, the content of Zn may be 0.25 mass % or less and the content of Zr may be 0.05 mass % or less.

According to the present disclosure, it becomes possible to provide aluminum alloy forgings with excellent mechanical properties and corrosion resistance at room temperature.

DETAILED DESCRIPTION OF THE INVENTION

Figure 1:
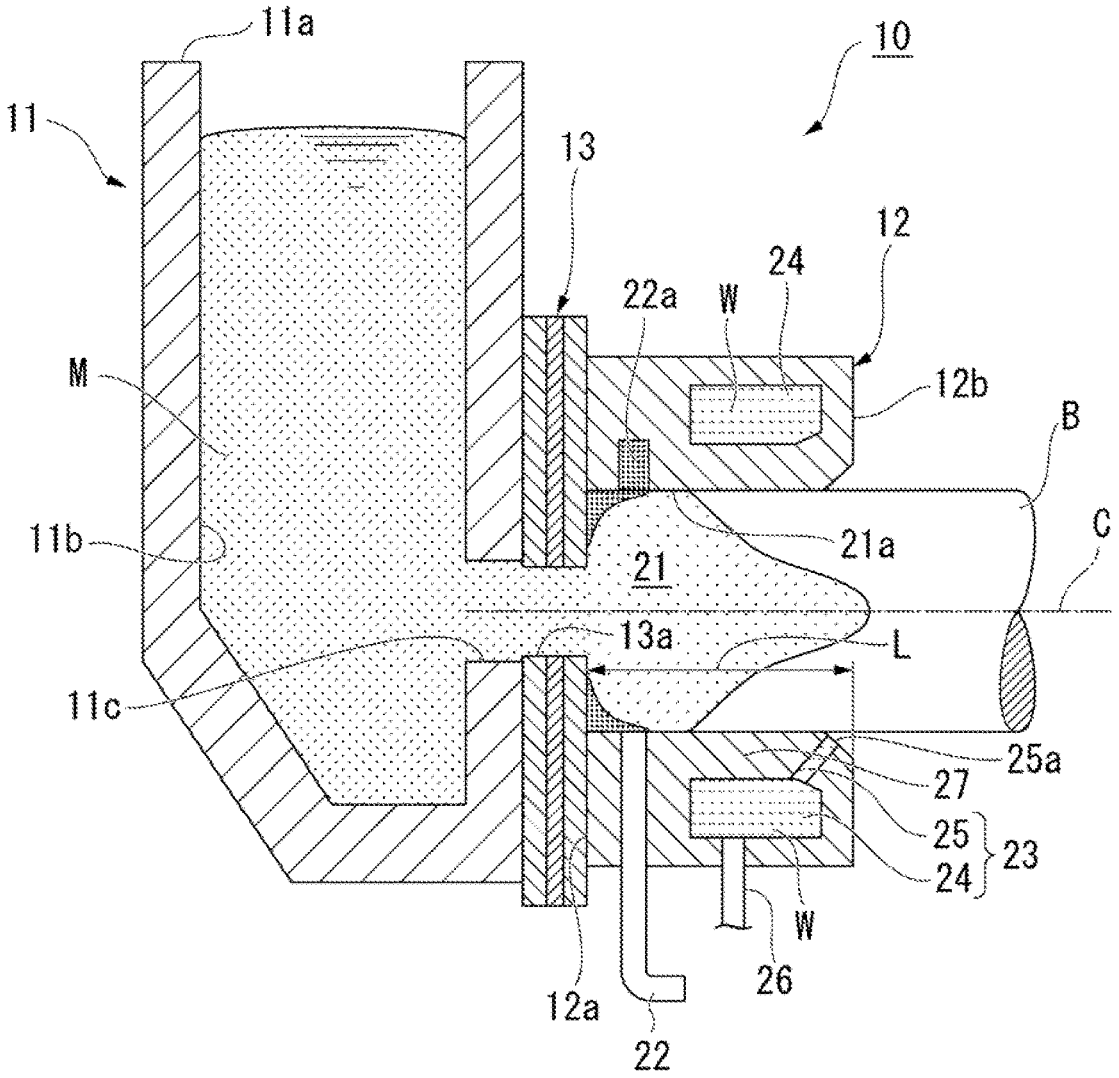
FIG. 1 is a schematic cross-sectional view of a main part showing an example of the vicinity of a mold of the horizontal continuous casting apparatus of the present disclosure.

The aluminum alloy forgings according to one embodiment of the present disclosure are described below. It should be noted that the following examples are explained specifically in order to give a better understanding of the intent of the invention, and the invention is not limited unless otherwise specified. In addition, in the drawings used in the following descriptions, the essential parts are sometimes enlarged for convenience in order to make the features of the present invention easy to understand, and the proportions of the dimensions of each component, etc., are not necessarily the same as in reality.

An aluminum alloy forging according to an embodiment of the present invention includes a Cu content in the range of 0.3 mass % to 1.0 mass %, a Mg content in the range of 0.63 mass % to 1.30 mass %, a Si content in the range of 0.45 mass % to 1.45 mass %, and the balance being Al and inevitable impurities.

In addition, the Mg content and Cu content of the aluminum alloy forging satisfy the following relation (1), and the Si content and Cu content satisfy the following relation (2);

$$[\text{Mg content}]\times 1.587 \geq -4.1\times[\text{Cu content}]^2+7.8\times[\text{Cu content}]-1.9 \quad (1)$$

$$[\text{Si content}]\times 2.730 \geq -4.1\times[\text{Cu content}]^2+7.8\times[\text{Cu content}]-1.9 \quad (2)$$

Furthermore, in addition to the components described above, the aluminum alloy forgings may include Mn content in the range of 0.03 mass % to 1.0 mass %, Fe content in the range of 0.2 mass % to 0.7 mass %, Cr content in the range of 0.03 mass % to 0.4 mass %, Ti content in the range of 0.012 mass % to 0.035 mass %, and B content in the range of 0.001 mass % to 0.03 mass %. The content of Zn may be 0.25 mass % or less and the content of Zr may be 0.05 mass % or less. The aluminum alloy forgings of the present embodiment is equivalent to the forged 6000 series aluminum alloy in that it contains Mg and Si.

(Cu: 0.30 Mass % or More and 1.0 Mass % or Less)

Copper (Cu) has the effect of dispersing Mg—Si-based compounds finely in aluminum alloys and improving the tensile strength of aluminum alloys by precipitating them as Al—Cu—Mg—Si-based compounds including Q phase. With the Cu content within the above range, the mechanical properties of aluminum alloy forged products at room temperature can be improved.

(Mg: 0.63 Mass % or More and 1.30 Mass % or Less)

Magnesium (Mg) has the effect of improving the tensile strength of aluminum alloys. The solid solution of Mg into the aluminum matrix or the precipitation as Mg—Si-based compounds such as β" phase ($Mg_2Si$) or Al—Cu—Mg—Si-based compounds such as Q phase (AlCuMgSi) contributes to the strengthening of aluminum alloys. $Mg_2Si$ also acts to suppress the formation of $CuAl_2$ phase in aluminum alloys. The corrosion resistance of aluminum alloy forged products are enhanced by the suppression of $CuAl_2$ phase formation. The Mg content within the above range can improve corrosion resistance as well as mechanical properties at room temperature of aluminum alloy forged products.

(Si: 0.45 Mass % or More and 1.45 Mass % or Less)

Silicon (Si), like Mg, has the effect of improving corrosion resistance as well as mechanical properties at room temperature of aluminum alloy forged products. However, if too much Si is added to the aluminum alloy, the tensile strength of the aluminum alloy may decrease due to the crystallization of coarse primary Si grains. With the content of Si within the above range, it is possible to improve the corrosion resistance as well as the mechanical properties at room temperature of aluminum alloy forged products while suppressing the crystallization of primary Si.

(Mn: 0.03 Mass % or More and 1.0 Mass % or Less)

Manganese (Mn) has the effect of improving the tensile strength of aluminum alloys by forming intermetallic compounds such as Al—Mn—Fe—Si and Al—Mn—Cr—Fe—Si in aluminum alloys as crystalline products or precipitates. With the Mn content within the above range, the mechanical properties of aluminum alloy forged products at room temperature can be improved.

(Fe: 0.2 Mass % or More and 0.7 Mass % or Less)

Iron (Fe) has the effect of improving the tensile strength of aluminum alloys by forming intermetallic compounds such as Al—Fe—Si, Al—Fe—Cr, Al—Mn—Fe—Si, Al—Mn—Cr—Fe—Si, Al—Cu—Fe, and Al—Mn—Fe in aluminum alloys as crystalline products or precipitates. With the Fe content within the above range, the mechanical properties of aluminum alloy forged products at room temperature can be improved.

(Cr: 0.03 Mass % or More and 0.4 Mass % or Less)

Chromium (Cr) has the effect of improving the tensile strength of aluminum alloys by forming intermetallic compounds such as Al—Cr—Si, Al—Mn—Cr—Fe—Si and Al—Fe—Cr in the aluminum alloys as crystalline products or precipitates. With the Cr content within the above range, the mechanical properties of aluminum alloy forged products at room temperature can be improved.

(Ti: 0.012 Mass % or More and 0.035 Mass % or Less)

Titanium (Ti) has the effect of refining the grain size of aluminum alloy and improving the ductility and the workability. When the Ti content is less than 0.012 mass %, the grain refinement effect may not be sufficiently obtained. On the other hand, when the Ti content exceeds 0.035 mass %, coarse crystals or precipitates are formed, which may reduce the ductility and the workability. In addition, a large amount of coarse precipitates or precipitates containing Ti in forged aluminum alloys may reduce toughness. Therefore, the content of Ti should be 0.012 mass % or more and 0.035 mass % or less. The content of Ti is preferably 0.015 mass % or more and 0.030 mass % or less.

(B: 0.001 Mass % or More and 0.03 Mass % or Less)

Boron (B) has the effect of refining the grain size of aluminum alloy and improving the ductility and the workability. The addition of B to the aluminum alloy along with the aforementioned Ti improves the grain refinement effect. When the B content is less than 0.001 mass %, the grain refinement effect may not be sufficiently obtained. On the other hand, when the content of B exceeds 0.03 mass %, coarse crystals or precipitates may be formed and mixed into the aluminum alloy forgings as inclusions. In addition, if a large amount of coarse crystals or precipitates containing B is mixed into the final product of aluminum alloy, toughness may be reduced. Therefore, the content of B should be 0.001 mass % or more and 0.03 mass % or less. The content of B is preferably 0.005 mass % or more and 0.025 mass % or less.

(Zn: 0.25 Mass % or Less)

Zinc (Zn) contributes to the strength enhancement of aluminum alloy forgings as solid solution strengthening if it is below 0.25 mass %. However, when the content of Zn exceeds 0.25 mass %, it precipitates as $MgZn_2$ on the aluminum matrix, which may lead to a decrease in the corrosion resistance of aluminum alloy forgings. Therefore, the content of Zn is preferably 0.25 mass % or less. The content of Zn is preferably 0.005 mass % or more.

(Zr: 0.05 Mass % or Less)

Zirconium (Zr) precipitates in the form of $Al_3Zr$ and Al-(Ti, Zr) below 0.05 mass %, which contributes to the strengthening of aluminum alloy forgings by suppressing recrystallization and strengthening precipitation. However, when the Zr content exceeds 0.05 mass %, it crystallizes as a coarse Zr compound, which may lead to a decrease in the corrosion resistance of aluminum alloy forgings. Therefore, the Zr content is preferably 0.05 mass % or less. The Zr content is preferably 0.005 mass % or more.

(Inevitable Impurities)

Inevitable impurities are those impurities that inevitably enter the aluminum alloy from the raw material of the forged aluminum alloy or from the manufacturing process. Examples of unavoidable impurities include Ni, Sn and Be. Preferably, the content of these inevitable impurities does not exceed 0.1 mass %.

(Mg Content and Cu Content, Si Content and Cu Content)

The Mg content and the Cu content are made to satisfy the above relation (1). The left side of relation (1), "[Mg content]×1.587," corresponds to the Mg content of the forged aluminum alloy converted to the $Mg_2Si$ content. That is, relation (1) above shows the relationship between the equivalent $Mg_2Si$ content, which is calculated from the Mg content of the forged aluminum alloy, and the Cu content. The Si content and the Cu content are made to satisfy the above relation (2). The left side of relation (2), "[Si content]×2.730" corresponds to the Si content of the forged aluminum alloy converted to the $Mg_2Si$ content. That is, relation (2) above shows the relationship between the equivalent $Mg_2Si$ content, which is calculated from the Si content of the forged aluminum alloy, and the Cu content.

The relations (1) and (2) above are experimentally determined. In other words, the relations were determined by a graph (FIG. 5) showing the relationship between the Cu content, the $Mg_2Si$ equivalent content and the corrosion resistance of the aluminum alloy forgings prepared in the experimental examples described below. By satisfying relations (1) and (2) above, the formation of $CuAl_2$ phase in the aluminum alloy can be suppressed. The lower value of the reduced $Mg_2Si$ content calculated by relations (1) and (2) is preferably in the range of 1.0 mass % to 2.0 mass %.

(Ratio of Si Content to Mg Content, Si/Mg Molar Ratio)

The ratio of Si content to Mg content, Si/Mg, in terms of the molar ratio (Si/Mg molar ratio) may be 0.5 or more or less than 0.5 moles.

When the Si/Mg molar ratio is 0.5 or more, the Mg content is preferably in the range of 0.63 mass % to 1.25 mass %, and the Si content is preferably in the range of 0.60 mass % to 1.45 mass %. When the Si/Mg molar ratio is greater than 0.5, the content of Si that does not form $Mg_2Si$ or AlCuMgSi increases, leading to the formation of Si-rich precipitates in aluminum alloy forgings. This Si-rich precipitate contributes to the enhancement of the strength of aluminum alloy forgings. When the Si/Mg molar ratio is 0.5 or more, the Si/Mg molar ratio is preferably 0.60 or more and 1.20 or less.

When the Si/Mg molar ratio is less than 0.5, the Mg content is preferably 0.85 mass % or more and 1.30 mass % or less and the Si content is preferably 0.45 mass % or more and 0.69 mass % or less. When the Si/Mg mole ratio is less than 0.5, the amount of $Mg_2Si$ (β" phase) and AlCuMgSi (Q phase) formed increases, and the forged aluminum alloy is excellent in solid solution/precipitation strengthening. When the Si/Mg molar ratio is less than 0.5, the Si/Mg molar ratio is preferably 0.40 or more and 0.48 or less.

In the forged aluminum alloy of this embodiment, the ratio Q1/Q2 of the integrated intensity Q1 of the X-ray diffraction peak of the $CuAl_2$ phase to the integrated intensity Q2 of the X-ray diffraction peak of the (200) plane of the Al phase obtained by the X-ray diffraction method is $2\times10^{-1}$ or less. The integrated intensity Q2 of the X-ray diffraction peak of the (200) plane of the Al phase can be the integrated intensity of the X-ray diffraction peak detected within the range of 37.8 to 39.8 degrees at the diffraction angle 2θ in the X-ray diffraction pattern obtained by the X-ray diffraction method using the Cu-Kα ray as the X-ray source. In addition, the X-ray diffraction peak intensity Q1 of the $CuAl_2$ phase can be the integrated intensity of the X-ray diffraction peak detected within the range of 42.5 to 43.5 degrees at the diffraction angle 2θ in the X-ray diffraction pattern obtained by the X-ray diffraction method using the Cu-Kα ray as the X-ray source. The aluminum alloy forgings of this embodiment have a ratio Q1/Q2 of $2\times10^{-1}$ or less, and it is considered that the corrosion resistance is improved because the content of the $CuAl_2$ phase is small. The ratio Q1/Q2 below $2\times10^{-1}$ includes the case where the X-ray diffraction peak of the $CuAl_2$ phase is not detected, i.e., Q1=0.

Next, the method of manufacturing the aluminum alloy forgings of this embodiment will be described.

The aluminum alloy forgings of this embodiment can be produced by a method that includes, for example, a molten metal forming step, a casting step, a homogenizing heat treatment step, a forging step, a solution treatment step, a quenching step, and an aging treatment step.

(Molten Metal Forming Step)

The molten metal forming step is a step of obtaining an aluminum alloy melt whose composition is prepared by dissolving the raw material. The composition of the molten aluminum alloy is the same as that of the forged aluminum alloy. The aluminum alloy melt can be obtained by heating and melting the aluminum alloy. In addition, a single element or a compound containing two or more elements as a raw material for an aluminum alloy may be formed by melting a mixture containing the desired aluminum alloy at the rate of production. For example, Ti or B may be mixed as a grain refiner such as an Al—Ti—B rod in order to control the grain size of the aluminum alloy produced in the casting step.

(Casting Step)

In the casting step, a molten aluminum alloy (liquid phase) is cooled and solidified into a solid (solid phase) to obtain an aluminum alloy forging. The casting step can, for example, use a horizontal continuous casting method. FIG. 1 is a cross-sectional view showing an example of a horizontal continuous casting apparatus that can be used for manufacturing aluminum alloy forging of this embodiment, and an enlarged sectional view of the main part showing the vicinity of the coolant cavity of the horizontal continuous casting apparatus shown in FIG. 1.

Figure 2:
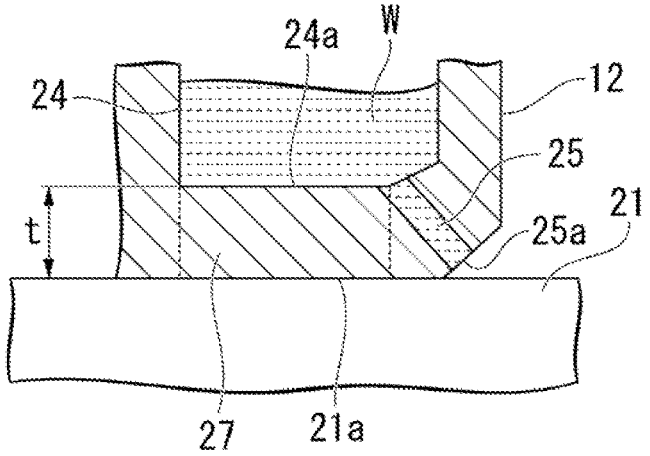
FIG. 2 is an enlarged cross-sectional view of a main part showing the vicinity of the cooling water cavity shown in FIG. 1.

The horizontal continuous casting apparatus 10 shown in FIGS. 1 and 2 has a molten metal receiving portion (tundish) 11, a hollow cylindrical mold 12, and a refractory plate-like body (thermal insulation member) 13 arranged between one end side 12*a* of the mold 12 and the molten metal receiving portion 11.

The molten metal receiving portion 11 includes a molten metal inlet 11*a* receiving the aluminum alloy molten metal M obtained in the above molten metal forming step, a molten metal holding portion 11*b*, and an outlet 11*c* to the hollow portion 21 of the mold 12. The molten metal receiving portion 11 maintains the level of the upper liquid surface of the aluminum alloy melt M at a position higher than the upper surface of the hollow portion 21 of the mold 12, and stably distributes the aluminum alloy melt M to each mold 12 in the case of multiple casting.

The molten aluminum alloy M held by the molten metal holding portion 11*b* in the molten metal receiving portion 11 is poured into the hollow portion 21 of the mold 12 from a pouring passage 13*a* provided in the refractory plate-like body 13. The molten alloy M supplied into the hollow portion 21 is cooled and solidified by a cooling device 23 to be described later, and is drawn out from the other end side 12*b* of the mold 12 as an aluminum alloy cast rod B which is a solidified ingot.

On the other end side 12*b* of the mold 12, there may be provided a pull-out driving device (not shown) for pulling out the aluminum alloy cast rod B at a constant speed. It is also preferable that a synchronous cutter (not shown) for cutting the continuously drawn aluminum alloy cast rod B to an arbitrary length is provided.

The refractory plate-like body 13 is a member that blocks heat transfer between the molten metal receiving portion 11 and the mold 12, and may be made of a material such as calcium silicate, alumina, silica, a mixture of alumina and silica, silicon nitride, silicon carbide, graphite, or the like. The refractory plate-like body 13 may be composed of a plurality of layers of mutually different constituent materials.

The mold 12 is a hollow cylindrical member in the present embodiment, and is formed of one or a combination of two or more materials selected from, for example, aluminum, copper, or alloys thereof. For the material of the mold 12, the optimum combination may be selected from the viewpoint of thermal conductivity, heat resistance, and mechanical strength.

The hollow portion 21 of the mold 12 is formed to have a circular cross section in order to make the aluminum alloy cast rod B to be cast into a cylindrical rod shape. The mold 12 is held so that the mold center axis (center axis) C passing through the center of the hollow portion 21 is substantially along the horizontal direction.

The inner peripheral surface 21*a* of the hollow portion 21 of the mold 12 is formed at an elevation angle of 0° to 3° (more preferably 0° to 1°) with respect to the mold central axis C in the casting direction of the aluminum alloy cast rod B. That is, the inner peripheral surface 21*a* is formed in a tapered shape that opens like a cone toward the drawing direction. The angle formed by the taper is an elevation angle.

When the elevation angle is less than 0°, the aluminum alloy cast rod B receives resistance at the other end side 12*a* as the mold outlet when it is pulled out from the mold 12, so that casting becomes difficult. On the other hand, when the elevation angle exceeds 3°, the contact of the inner peripheral surface 21*a* with the molten aluminum alloy M becomes insufficient. For this, there is a concern that solidification may be insufficient because the heat extraction effect from the molten aluminum alloy M or the solidified shell in which the molten alloy M is cooled and solidified to the mold 12 decreases. As a result, a remelted skin may occur on the surface of the aluminum alloy cast rod B, or that unsolidified alloy molten metal M will be ejected from the end of the aluminum alloy cast rod B, which is not preferable because it is more likely to lead to casting trouble.

The cross-sectional shape of the hollow portion 21 of the mold 12 (the planar shape when the hollow portion 21 of the mold 12 is viewed from the other end side) may be selected according to the shape of the aluminum alloy cast rod to be cast, such as a triangular or rectangular cross-sectional shape, a polygonal shape, a semicircular shape, an ellipse shape, a shape having a deformed cross-sectional shape having no axis or plane of symmetry, in addition to the circular shape of the present embodiment.

A fluid supply pipe 22 for supplying lubricating fluid into the hollow portion 21 of the mold 12 is disposed on one end side 12*a* of the mold 12. The lubricating fluid supplied from the fluid supply pipe 22 may be one or more lubricating fluids selected from a gas lubricant and a liquid lubricant. When both the gas lubricant and the liquid lubricant are supplied, it is preferable to provide the fluid supply tubes separately. The lubricating fluid supplied under pressure from the fluid supply pipe 22 is supplied into the hollow portion 21 of the mold 12 through the annular lubricant supply port 22*a*.

In this embodiment, the pressure-fed lubricating fluid is supplied from the lubricant supply port 22*a* to the inner peripheral surface 21*a* of the mold 12. The liquid lubricant may be heated to form a decomposed gas and supplied to the inner peripheral surface 21*a* of the mold 12. Further, a porous material may be disposed at the lubricant supply port 22*a*, and lubricating fluid may be exuded to the inner peripheral surface 21*a* of the mold 12 through the porous material.

A cooling device 23 as a cooling means for cooling and solidifying the molten alloy M is formed inside the mold 12. The cooling device 23 of the present embodiment includes a cooling water cavity 24 for containing cooling water W for cooling the inner peripheral surface 21*a* of the hollow portion 21 of the mold 12, and a cooling water injection passage 25 for communicating the cooling water cavity 24 with the hollow portion 21 of the mold 12.

The cooling water cavity 24 is annularly formed inside the mold 12 and outside the inner peripheral surface 21*a* of the hollow portion 21 so as to surround the hollow portion 21, and the cooling water W is supplied through the cooling water supply pipe 26.

When the inner peripheral surface 21*a* is cooled by the cooling water W accommodated in the cooling water cavity 24, the mold 12 removes the heat of the molten alloy M filled in the hollow portion 21 of the mold 12 from the surface of the molten alloy M in contact with the inner peripheral surface 21*a* of the mold 12 to form a solidified shell on the surface of the molten alloy M.

The cooling water injection passage 25 cools the aluminum alloy cast rod B by directly applying cooling water to the aluminum alloy cast rod B at the other end 12*b* of the mold 12 from the shower opening 25*a* facing the hollow part 21. The longitudinal sectional shape of the cooling water injection passage 25 may be, for example, a semicircle, a pear shape or a horseshoe shape in addition to the circular shape of the present embodiment.

In the present embodiment, the cooling water W supplied through the cooling water supply pipe 26 is first accommodated in the cooling water cavity 24 to cool the inner peripheral surface 21*a* of the hollow portion 21 of the mold 12, and the cooling water W of the cooling water cavity 24 is injected from the cooling water injection passage 25 toward the aluminum alloy cast rod B.

The length from the position where the extension line of the central axis of the shower opening 25*a* of the cooling water injection passage 25 strikes the surface of the cast aluminum alloy rod B to the contact surface between the mold 12 and the refractory plate-like body 13 is referred to as the effective mold length L, and the effective mold length L is preferably, for example, 10 mm to 40 mm. When the effective mold length L is less than 10 mm, casting is not possible because a good film is not formed or for other reasons. When the effective mold length L is more than 40 mm, the effect of forced cooling is not effective, solidification by the mold wall becomes dominant, contact resistance between the mold 12 and the molten alloy M or the aluminum alloy cast rod B becomes large, and cracking occurs on the casting surface, 1000 pieces are cut in the mold, and casting becomes unstable, which is undesirable.

It is preferable that the operation of the cooling water supply to the cooling water cavity 24 and the cooling water injection from the shower opening 25*a* of the cooling water injection passage 25 can be controlled by a control signal from a controller (not shown).

The cooling water cavity 24 is formed such that the inner bottom surface 24*a* of the mold 12 near the hollow portion 21 is parallel to the inner peripheral surface 21*a* of the hollow portion 21 of the mold 12. The term "parallel" here also includes a case where the inner peripheral surface 21*a* of the hollow portion 21 of the mold 12 is formed at an elevation angle of 0° to 3° with respect to the inner bottom surface 24*a* of the cooling water cavity 24, that is, the inner bottom surface 24*a* is inclined at an angle of more than 0° to 3° with respect to the inner peripheral surface 21*a*.

As shown in FIG. 2, the cooling wall 27 of the mold 12, which is a portion where the inner bottom surface 24*a* of the cooling water cavity 24 and the inner peripheral surface 21*a* of the hollow portion 21 of the mold 12 face each other, is formed so that the heat flux value per unit area from the molten alloy M of the hollow portion 21 toward the cooling water W of the cooling water cavity 24 is in the range of $10\times10^5$ W/m$^2$ or more and $50\times10^5$ W/m$^2$ or less.

The mold 12 may be formed such that the thickness t of the cooling wall 27 of the mold 12, that is, the distance between the inner bottom surface 24*a* of the cooling water cavity 24 and the inner peripheral surface 21*a* of the hollow portion 21 of the mold 12, is in a range of, for example, from 0.5 mm to 3.0 mm, preferably from 0.5 mm to 2.5 mm. Further, the material for forming the mold 12 may be selected so that the thermal conductivity of at least the cooling wall 27 of the mold 12 is in the range of 100 W/m·K or more and 400 W/m·K or less.

In FIG. 2, the molten alloy M in the molten metal receiving portion 11 is supplied from one end side 12*a* of the mold 12, which is held through the refractory plate-like body 13 so that the central axis C of the mold is substantially horizontal, and is forcibly cooled at the other end side 12*b* of the mold 12 to form the aluminum alloy cast rod B. Since the aluminum alloy cast rod B is drawn out at a constant speed by a drawing driving device (not shown) installed near the other end side 12*b* of the mold 12, the aluminum alloy cast rod B is continuously cast to form a long aluminum alloy cast rod B. The extracted aluminum alloy casting rod B is cut to a desired length by, for example, a tuning cutter (not shown).

The composition ratio of the aluminum alloy cast rod B can be confirmed by, for example, a method using a photoelectrophotometric emission spectrophotometer (apparatus example: PDA-5500 manufactured by Japan Shimadzu Corporation) as described in JIS H 1305.

The difference between the height of the liquid level of the molten alloy M stored in the molten metal receiving portion 11 and the height of the inner peripheral surface 21*a* on the upper side of the mold 12 is preferably 0 mm to 250 mm (more preferably 50 mm to 170 mm). In such a range, the pressure of the molten alloy M supplied into the mold 12 and the lubricant and the gas in which the lubricant is vaporized are suitably balanced, thereby stabilizing castability.

As the liquid lubricant, vegetable oil as a lubricant can be used. For example, rapeseed oil, castor oil and vegetable oil can be cited. These are preferable because they have little adverse effect on the environment.

The lubricant supply is preferably from 0.05 mL/min to 5 mL/min (more preferably 0.1 mL/min to 1 mL/min.). If the supply amount is too small, the molten alloy of the aluminum alloy casting rod B may leak from the mold without solidifying due to insufficient lubrication. If the supply amount is excessive, the surplus may be mixed into the aluminum alloy casting rod B and cause internal defects.

The casting speed, which is the rate at which the aluminum alloy casting rod B is withdrawn from the mold 12, is preferably from 200 mm/min to 1500 mm/min (more preferably 400 mm/min to 1000 mm/min.). This is because, if the casting speed is in this range, the network structure of the crystallized product formed in the casting becomes uniform and fine, the resistance to deformation of the aluminum fabric under high temperature increases, and the high temperature mechanical strength improves.

The amount of cooling water injected from the shower opening 25*a* of the cooling water injection passage 25 is preferably from 10 L/min to 50 L/min per mold (more preferably 25 L/min to 40 L/min.). If the amount of cooling water is smaller than this range, the molten alloy may leak from the mold without solidifying. Further, the surface of the cast aluminum alloy cast rod B is remelted to form a non-uniform structure, which may remain as an internal defect. On the other hand, when the amount of cooling water is larger than this range, there is a possibility that heat extraction of the mold 12 is too large and solidifies in the middle.

The average temperature of the molten alloy M flowing into the mold 12 from the molten metal receiving portion 11 is preferably, for example, 650° C. to 750° C. (more preferably 680° C. to 720° C.). If the temperature of the molten alloy M is too low, coarse crystallized material are formed in the mold 12 and in front of the mold 12, and may be taken into the aluminum alloy casting rod B as an internal defect. On the other hand, if the temperature of the molten alloy M is too high, a large amount of hydrogen gas is easily taken into the molten alloy M, and may be taken into the aluminum alloy casting rod B as porosity, resulting in an internal cavity.

In the cooling wall 27 of the mold 12, as in the present embodiment, the heat flux value per unit area from the molten alloy M of the hollow portion 21 to the cooling water W of the cooling water cavity 24 is set in the range of $10\times10^5$ W/m$^2$ or more and $50\times10^5$ W/m$^2$ or less, thereby preventing the aluminum alloy casting rod B from seizure.

Figure 3:
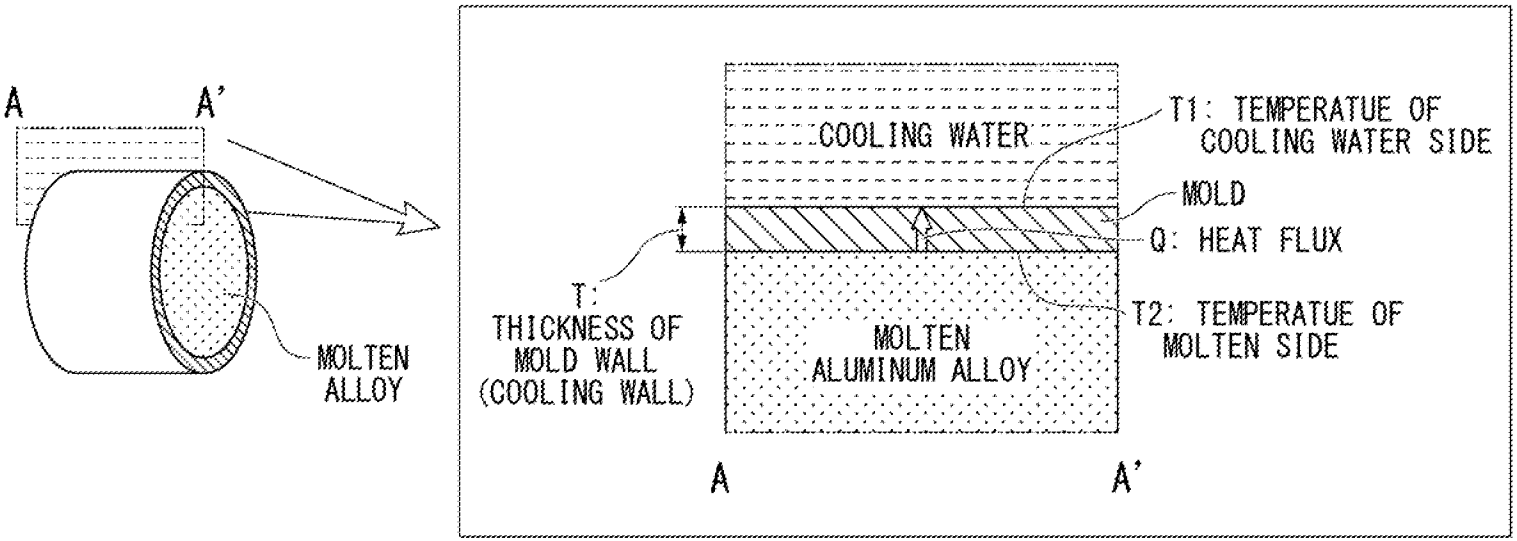
FIG. 3 is an explanatory diagram illustrating the heat flux of the cooling wall according to the present disclosure.

The cooling wall 27 of the mold 12 receives heat by heat extraction from the molten alloy M, and performs heat exchange by cooling the heat with cooling water W stored in the cooling water cavity 24. As shown in the explanatory diagram of FIG. 3, attention was paid to the heat flux per unit area.

The heat flux per unit area is expressed by the following equation (1) according to Fourier's law.

$$Q=-k\times\{(T1-T2)/L\} \quad (1)$$

Q: Heat Flux k: thermal conductivity (W/m·K) of the portion where heat passes (cooling wall 27 of mold 12 in this embodiment)

T1: the cold-side temperature at which heat passes (in this embodiment, the inner bottom surface 24*a* of the cooling water cavity 24)

T2: the high-temperature side temperature at which heat passes (in this embodiment, the inner peripheral surface 21*a* of the hollow portion 21 of the mold 12)

L: section length (mm) at which heat passes (in this embodiment, thickness t of the cooling wall 27 of the mold 12)

The cooling wall part 27 of the mold 12 is constituted so that the heat flux value per unit area is $10\times10^5$ W/m$^2$ or more based on the mold material, the thickness and the temperature measurement data obtained by obtaining a good result even if the amount of lubricant is reduced during casting, thereby preventing the cast aluminum alloy casting rod B from seizure. The heat flux value per unit area is preferably $50\times10^5$ W/m$^2$ or less.

In order to make the cooling wall 27 of the mold 12 in the range of such a heat flux value, the mold 12 may be formed so that the thickness t of the cooling wall 27 of the mold 12 is in the range of, for example, 0.5 mm or more and 3.0 mm or less. The thermal conductivity of at least the cooling wall 27 of the mold 12 may be set in a range of 100 W/m·K or more and 400 W/m·K or less.

In the method of manufacturing an aluminum alloy cast rod according to the present embodiment, the molten alloy M stored in the molten metal receiving portion 11 is continuously supplied into the hollow portion 21 from one end side 12*a* of the mold 12 by using the horizontal continuous casting apparatus 10 described above. Further, cooling water W is supplied to the cooling water cavity 24, and lubricating fluid such as lubricant is supplied from the fluid supply pipe 22.

The molten alloy M supplied into the hollow part 21 is cooled and solidified under the condition that the heat flux value per unit area in the cooling wall part 27 is $10\times10^5$ W/m$^2$ or more to cast the aluminum alloy cast rod B. At the time of casting the aluminum alloy cast rod B, the wall surface temperature of the cooling wall 27 of the mold 12 cooled by the cooling water W is preferably set to 100° C. or less.

The aluminum alloy casting rod B thus obtained is cooled and solidified under the condition that the heat flux value per unit area in the cooling wall 27 is $10\times10^5$ W/m$^2$ or more, whereby the adhesion of reaction products, for example, carbides, due to the contact between the gas of the lubricant and the molten alloy M, is suppressed. Thus, the aluminum alloy cast rod B can be manufactured in a high yield without cutting and removing carbides or the like on the surface of the aluminum alloy cast rod B.

The casting step for obtaining castings from the molten aluminum alloy is not limited to the horizontal continuous casting method described above, but a known continuous casting method such as vertical continuous casting can be used. The vertical continuous casting method is classified into the float method and the hot top method according to the method of feeding the molten aluminum alloy to the mold, and the case of using the hot top method is briefly described below. A casting apparatus used in the hot top method is equipped with a mold, a molten metal receiving portion (header), etc. The molten metal supplied to the molten metal receiving portion passes through the outlet and through the header to adjust the flow rate and enters a cylindrical mold installed almost horizontally, where it is forced to cool to form a solidified shell on the outer surface of the molten metal. In addition, cooling water is radiated directly to the castings drawn from the mold, and the castings are continuously drawn while the solidification of the metal progresses to the inside of the castings. Generally, the mold is made of a metal member with good thermal conductivity and has a hollow structure to introduce a refrigerant inside. The refrigerant to be used can be selected from industrially available refrigerants as appropriate, but water is recommended for ease of use. The mold used in the present embodiment is selected from metal such as copper or aluminum or graphite as appropriate from the viewpoint of heat transfer performance and durability at the contact with molten metal. The header, which is generally made of refractory material, is placed above the mold. The material and size of the header can be selected as appropriate according to the range of alloy components to be cast and the dimensions of the cast product, and are not particularly restricted. The average cooling rate during casting is, for example, in the range of 10° C./sec to 300° C./sec, and preferably in the range of 100° C./sec to 200° C./sec. The casting speed can be selected appropriately from the general range in horizontal continuous casting, for example, from the range of 200 mm/min to 600 mm/min. By the casting method described above, a uniform metallic structure can be obtained even for medium to large castings. The diameter of the target casting is not particularly limited, and it is suitable for bars with a diameter of 30 mm to 100 mm (Homogenizing Heat Treatment Step)

The homogenization heat treatment step is a step of homogenizing microsegregation caused by solidification, precipitation of supersaturated solid solution elements and transformation of metastable phase into equilibrium phase by performing homogenization heat treatment on aluminum alloy castings obtained in the casting step.

In the present embodiment, the aluminum alloy castings obtained in the casting step are subjected to homogenization heat treatment at a temperature of 370° C. to 560° C. for 4 to 10 hours. Homogenization heat treatment in this temperature range provides sufficient homogenization of aluminum alloy castings and infiltration of solute atoms. Therefore, sufficient strength required by subsequent aging treatment is obtained. The rate of temperature rise in homogenizing heat treatment of aluminum alloy castings is, for example, 1.5° C./min or more, and preferably 4.5° C./min.

(Forging Step)

The forging step is a step in which aluminum alloy castings after the homogenizing heat treatment step are molded to a specified size to obtain a forging material, the resulting forging material is heated to a specified temperature, and then the forging step is performed by applying pressure with a press.

In the present embodiment, it is preferable that the forging material is heated to a temperature of 450° C. to 560° C., and then forging is started to obtain the forging product (for example, suspension arm parts of an automobile). If the starting temperature of forging is less than 450° C., the deformation resistance may increase and sufficient machining may not be possible, while if the starting temperature of forging is more than 560° C., defects such as forging cracking and eutectic melting may easily occur. The rate of temperature rise when forging the forging material is, for example, 1.5° C./min or more, preferably 4.5° C./min.

(Solution Treatment Step)

The solution treatment step is a step in which the forged product obtained in the forging step is heated and solution-treated to alleviate the strain introduced into the cast product and to achieve solid solution of solute elements.

In the present embodiment, the solution treatment is preferably performed by holding the forgings at a treatment temperature of 530° C. to 560° C. for 0.3 to 3 hours. The rate of temperature rising from room temperature to the above processing temperature is preferably 5.0° C./min or more. If the treatment temperature is less than 530° C., the solution of solute elements becomes insufficient, and there is a risk that solution formation does not progress and it becomes difficult to achieve high strength by aging precipitation. On the other hand, when the treatment temperature exceeds 560° C., the solid solution of solute elements is promoted more, but eutectic melting and recrystallization may easily occur. In addition, if the temperature rising rate is less than 5.0° C./min, there is a risk of coarse precipitation of $Mg_2Si$.

(Quenching Step)

The quenching step is a step of rapidly cooling the solid solution forgings obtained by the solution treatment step to form a supersaturated solid solution.

In the present embodiment, quenching is performed by putting the forgings into a water tank in which water (quenched water) is stored and submerging the forgings. Water temperature in the water tank is preferably 20° C. to 60° C. The forging is preferably placed in the water bath so that all surfaces of the forging are in contact with water within 5 to 60 seconds after solution treatment. The submersion time of the forgings also depends on the size of the casting, for example, between more than 5 minutes and less than 40 minutes.

(Aging Treatment Step)

The aging step is a step in which the forgings is held by heating at a relatively low temperature and elements dissolved in supersaturation are precipitated to give an appropriate hardness.

In the present embodiment, aging treatment is performed by heating the forgings after the quenching step to a temperature of 180° C. to 220° C. and holding them at that temperature for 0.5 to 7.0 hours. If the heating temperature is less than 180° C. or the holding time is less than 0.5 hours, the $Mg_2Si$ that improves the tensile strength may not grow sufficiently, and if the processing temperature is more than 220° C., the $Mg_2Si$ may become too coarse to improve the tensile strength sufficiently.

The aluminum alloy forgings of the present embodiment have excellent mechanical properties at room temperature because the contents of Cu, Mg and Si are within the above range. In addition, the ratio Q1/Q2 of the X-ray diffraction peak intensity Q1 of the $CuAl_2$ phase to that of the X-ray diffraction peak intensity Q2 of the (200) plane of the Al phase obtained by the X-ray diffraction method is within the above range, so that the corrosion resistance is excellent.

In addition, the aluminum alloy forgings of the present embodiment have better mechanical properties at room temperature when the content of Mn, Fe and Cr is within the above range. Furthermore, when the content of Ti and B is within the above range, the ductility and the workability is improved.

EXAMPLES

Specific examples of the invention will be described. The present invention is not limited to these examples.

Experimental Examples

Aluminum alloys containing Mg and Si in the range of 1.0 mass % to 1.9 mass % as the Mg2Si equivalent content and Cu in the range of 0.3 mass % to 1.0 mass % were prepared. The prepared aluminum alloy was cast using the horizontal continuous casting machine shown in FIG. 1 to produce a continuous casting with a circular cross section of 49 mm in diameter. The cooling rate of the molten aluminum alloy during continuous casting was set at 120° C./sec.

Figure 4:
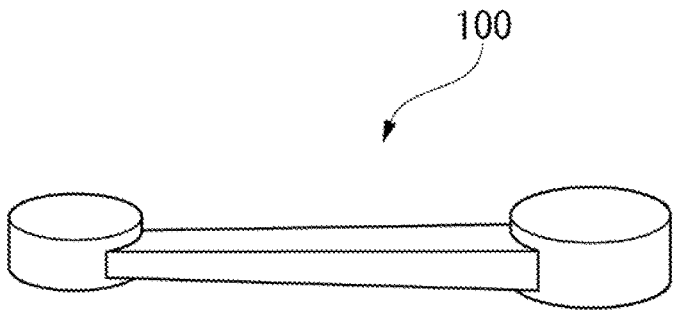
FIG. 4 is a perspective view of the forged aluminum alloy produced in the experimental examples and the examples.

The homogenizing heat treatment step, the forging step, the solution treatment step, the quenching step and the artificial aging treatment were applied in this order to the obtained continuous castings to obtain an aluminum alloy forging 100 with the shape shown in FIG. 4. The conditions of the homogenization heat treatment, the forging, the solution treatment, the quenching treatment and the artificial aging treatment are shown in Table 1 below.

TABLE 1

| Step | Conditions | |
|---|---|---|
| Homogenizing heat treatment | Temperature rising rate [° C./min] | 1.5 |
| | Temperature [° C.] | 470 |
| | Holding time [min] | 420 |
| Forging | Temperature rising rate [° C./min] | 5 |
| | Temperature [° C.] | 500 |
| Solution treatment | Temperature rising rate [° C./min] | 10 |
| | Temperature [° C.] | 545 |
| | Holding time [min] | 180 |
| Quenching treatment | Time to submerge [sec] | 15 |
| | Water temperature [° C.] | 60 |
| | Submersion Time [min] | 6 |
| Artificial aging treatment | Temperature [° C.] | 180 |
| | Holding time [min] | 300 |

C-ring pieces were taken from the obtained forged aluminum alloy and subjected to stress corrosion cracking tests (corrosion resistance evaluation). The conditions of the stress corrosion cracking test were carried out according to the provisions of the continuous immersion method of ASTM G 47 using the C-ring test pieces described above. Specifically, C-ring pieces were subjected to a stress of 90% of the 0.2% proof stress of the pieces and immersed for 80 hours in a mixture of sodium chloride and sodium chromate kept at 95 degrees C. or higher. The C-ring piece was then removed from the mixture and visually checked for stress corrosion cracking in the C-ring pieces. As a result, the C-ring pieces without stress corrosion cracking or grain boundary corrosion were classified as corrosion resistance "OK", and the C-ring specimens with the stress corrosion cracking or the grain boundary corrosion were classified as corrosion resistance "NG".

Figure 5:
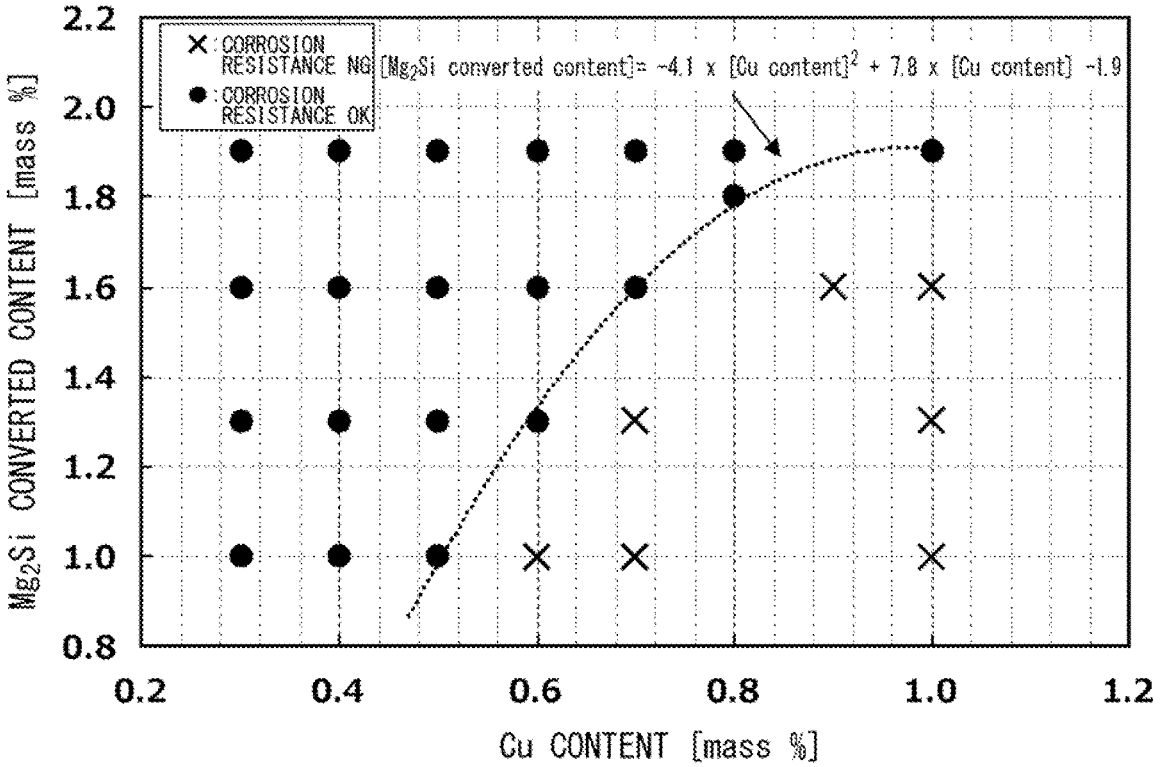
FIG. 5 is a graph showing the relationship between the Cu content, the $Mg_2Si$ converted content, and the corrosion resistance of the aluminum alloy forgings prepared in the experimental example.

The results of corrosion resistance evaluation are shown in FIG. 5. In the graph of FIG. 5, the horizontal axis represents the Cu content, the vertical axis represents the $Mg_2Si$ equivalent content, the black circle represents corrosion resistance "OK", and X represents corrosion resistance "NG". For each Cu content, the function of the dashed line connecting the black circles at the lowest $Mg_2Si$ equivalent content was obtained. The obtained function was as follows: [$Mg_2Si$ equivalent content]$=-4.1\times$[Cu content]$^2+7.8\times$[Cu content]$-1.9$. From this result, it can be seen that the aluminum alloy forgings satisfying the [$Mg_2Si$ equivalent content]$\geq-4.1\times$[Cu content]$^2+7.8\times$[Cu content]$-1.9$ have excellent corrosion resistance.

Example 1-5 and Comparative Example 1-2

Aluminum alloys with alloy compositions shown in Table 2 below were prepared. The prepared aluminum alloy was cast in the same manner as the above experimental examples to produce a continuous casting with a circular cross section of 49 mm in diameter. Table 2 shows the $Mg_2Si$ equivalent content based on the Mg content calculated using the left side of relation (1), the $Mg_2Si$ equivalent content based on the Si content calculated using the left side of relation (2), and the value calculated using the following relation (3), which is the right side of relation (1) and relation (2).

$$-4.1\times[\text{Cu content}]^2+7.8\times[\text{Cu content}]-1.9 \quad (3)$$

TABLE 2

| | Element content [mass %] | | | | | | | | | | Si/Mg | $Mg_2Si$ converted content [mass %] | | Value |
|---|---|---|---|---|---|---|---|---|---|---|---|---|---|---|
| | Cu | Mg | Si | Mn | Fe | Cr | Ti | B | Zn | Zr | molar | Mg content converted | Si content converted | derived in relation (3)[1)] |
| Example 1 | 0.3 | 0.90 | 1.15 | 0.5 | 0.23 | 0.15 | 0.02 | 0.01 | 0.01 | 0.01 | 1.11 | 1.43 | 3.14 | 0.07 |
| Example 2 | 0.4 | 0.90 | 1.15 | 0.5 | 0.23 | 0.15 | 0.02 | 0.01 | 0.01 | 0.01 | 1.11 | 1.43 | 3.14 | 0.56 |
| Example 3 | 1.0 | 1.25 | 1.35 | 0.5 | 0.23 | 0.15 | 0.02 | 0.01 | 0.01 | 0.01 | 0.93 | 1.98 | 3.69 | 1.80 |
| Example 4 | 0.7 | 1.00 | 1.00 | 0.5 | 0.23 | 0.15 | 0.02 | 0.01 | 0.01 | 0.01 | 0.87 | 1.59 | 3.14 | 1.55 |
| Example 5 | 0.4 | 1.20 | 0.65 | 0.3 | 0.30 | 0.20 | 0.02 | 0.01 | 0.01 | 0.01 | 0.43 | 1.90 | 2.73 | 0.56 |
| Comparative Example 1 | 0.7 | 0.90 | 1.15 | 0.5 | 0.23 | 0.15 | 0.02 | 0.01 | 0.01 | 0.01 | 1.11 | 1.43 | 1.77 | 1.55 |
| Comparative Example 2 | 1.0 | 0.90 | 1.15 | 0.5 | 0.23 | 0.15 | 0.02 | 0.01 | 0.01 | 0.01 | 1.11 | 1.43 | 3.14 | 1.80 |

[1)] $-4.1 \times [\text{Cu content}]^2 + 7.8 \times [\text{Cu content}] - 1.9$ (3)

As in the experimental examples above, the homogenizing heat treatment step, the forging step, the solution treatment step, the quenching step and the artificial aging treatment were applied in this order to the obtained continuous castings to obtain an aluminum alloy forging 100 with the shape shown in FIG. 4.

Evaluations

Each aluminum alloy forge obtained as described above was evaluated based on the following evaluation method. The results are shown in Table 3 below.

[Proof Stress Evaluation Method at Normal Temperature]

Among the obtained aluminum alloy forgings, a tensile test piece of a gauge distance of 25.4 mm and a parallel-portion diameter of 6.4 mm was taken. By performing a normal temperature (25° C.) tensile test for the tensile test piece, the proof stress was measured, and evaluation was performed based on the following criteria.

(Criteria)

"O": Proof stress at normal temperature is greater than or equal to 370 MPa

"X": Proof stress at normal temperature is less than 370 MPa.

[Corrosion Resistance Evaluation Method]

C-ring pieces were taken from the forged aluminum alloy and subjected to the stress corrosion cracking test as in the above experimental examples. C-ring pieces were evaluated for the presence or absence of stress corrosion cracking based on the following criteria:

(Criteria)

"X": Stress corrosion cracking was present in the C-ring piece.

"Δ (not good)": No stress corrosion cracking was present in the C-ring piece, but there is grain boundary corrosion occurring that is likely to lead to stress corrosion cracking.

"O (good)": Neither stress corrosion cracking nor grain boundary corrosion was present in the C-ring piece.

[Integrated Intensity Evaluation Method for X-Ray Diffraction Peaks of Al and $CuAl_2$ Phases]

X-ray diffraction measurements were performed on each aluminum alloy forgings using an X-ray diffractometer (SmartLab, manufactured by Rigaku, Inc.). Cu-Kα ray was used as the X-ray source. For X-ray diffraction measurements, plate-like pieces of 10 mm×10 mm×2 mm in thickness were taken from the aluminum alloys forgings. From the X-ray diffraction pattern obtained by X-ray diffraction measurement, the integrated intensity Q2 of the X-ray diffraction peak of the (200) plane of the Al phase within the range of 37.8 to 39.8 degrees at the diffraction angle 2θ and the integrated intensity Q1 of the X-ray diffraction peak of the $CuAl_2$ phase within the range of 42.5 to 43.5 degrees at the diffraction angle 2θ were obtained, and the value of the ratio Q1/Q2 was calculated. The resulting Q1/Q2 was evaluated based on the following criteria:

(Criteria)

"O": Q1/Q2 is less than or equal to 0.20.

"X": Q1/Q2 exceeds 0.20.

[Comprehensive Evaluation]

Three evaluation results of proof stress at room temperature, corrosion resistance and microstructure were evaluated based on the following criteria.

(Criteria)

"O": All three evaluations are "O".

"X": One or more of the three evaluations is an "X".

TABLE 3

| | Proof stress at normal temperature | | Corrosion resistance | | Microstructure | | Compre- |
|---|---|---|---|---|---|---|---|
| | Proof stress [MPa] | Evaluation | Cracking | Evaluation | Ratio of integrated intensity, Q1/Q2 | Evaluation | hensive evaluation |
| Example 1 | 370 | ○ | None | ○ | 0.11 | ○ | ○ |
| Example 2 | 372 | ○ | None | ○ | 0.15 | ○ | ○ |
| Example 3 | 384 | ○ | None | ○ | 0.18 | ○ | ○ |
| Example 4 | 378 | ○ | None | ○ | 0.17 | ○ | ○ |
| Example 5 | 370 | ○ | None | ○ | 0.12 | ○ | ○ |
| Comparative Example 1 | 377 | ○ | Some | x | 0.38 | x | x |
| Comparative Example 2 | 382 | ○ | Some | x | 0.34 | x | x |

From the results in Table 3, it was confirmed that the aluminum alloy forgings containing Cu, Mg, and Si within the range of the present disclosure and the content of Cu relative to the equivalent content of $Mg_2Si$ within the range of the present disclosure had excellent proof stress at room temperature and corrosion resistance because the ratio of the integrated intensity Q1 of the X-ray diffraction peak of the $CuAl_2$ phase to the integrated intensity Q2 of the X-ray diffraction peak of the (200) plane of the Al phase obtained by the X-ray diffraction method was less than $2\times10^{-1}$. On the other hand, it was confirmed that in the aluminum alloy forgings of Comparative Examples 1 and 2, in which the Cu content relative to the $Mg_2Si$ equivalent content exceeds the range of the present disclosure, the ratio Q1/Q2 exceeded $2\times10^{-1}$, and a large amount of $CuAl_2$ phase was formed, which indicates that corrosion resistance is reduced.

What is claimed is:

1. An aluminum alloy forging, comprising: 0.3 mass % or more and 1. 0 mass % or less of Cu; 0.63 mass % or more and 1.30 mass % or less of Mg; 0.45 mass % or more and 1.45 mass % or less of Si; 0.03 mass % or more and 0.25 mass % or less of Cr; and 0.05 mass % or less of Zr; the balance being Al and inevitable impurities, wherein the following relations are satisfied, $$[\text{Mg content}]\times1.587\geq-4.1\times[\text{Cu content}]^2+7.8\times[\text{Cu content}]-1.9 \quad (1)$$

$$[\text{Si content}]\times2.730\geq-4.1\times[\text{Cu content}]^2+7.8\times[\text{Cu content}]-1.9 \quad (2)$$

and the ratio of the integrated intensity Q1 of the X-ray diffraction peak of the $CuAl_2$ phase to the integrated intensity Q2 of the X-ray diffraction peak of the (200) plane of the Al phase obtained by the X-ray diffraction method, Q1/Q2, is $2\times10^{-1}$ or less.

2. The aluminum alloy forging according to claim 1, wherein the content of Mg is 0.63 mass % or more and 1.25 mass % or less, the content of Si is 0.60 mass % or more and 1.45 mass % or less, and the ratio of the content of Si to the content of Mg, Si/Mg, is 0.5 or more in the molar ratio.

3. The aluminum alloy forging according to claim 1, wherein the content of Mg is 0.85 mass % or more and 1.30 mass % or less, the content of Si is 0.45 mass % or more and 0.69 mass % or less, and the ratio of the content of Si to the content of Mg, Si/Mg, is less than 0.5 in the molar ratio.

4. The aluminum alloy forging according to claim 1, wherein the content of Mn is 0.03 mass % or more and 1.0 mass % or less, the content of Fe is 0.2 mass % or more and 0.7 mass % or less, the content of Ti is 0.012 mass % or more and 0.035 mass % or less, the content of B is 0.001 mass % or more and 0.03 mass % or less, and the content of Zn is 0.25 mass % or less.

5. The aluminum alloy forging according to claim 2, wherein the content of Mn is 0.03 mass % or more and 1.0 mass % or less, the content of Fe is 0.2 mass % or more and 0.7 mass % or less, the content of Ti is 0.012 mass % or more and 0.035 mass % or less, the content of B is 0.001 mass % or more and 0.03 mass % or less, and the content of Zn is 0.25 mass % or less.

6. The aluminum alloy forging according to claim 3, wherein the content of Mn is 0.03 mass % or more and 1.0 mass % or less, the content of Fe is 0.2 mass % or more and 0.7 mass % or less, the content of Ti is 0.012 mass % or more and 0.035 mass % or less, the content of B is 0.001 mass % or more and 0.03 mass % or less, and the content of Zn is 0.25 mass % or less.

7. The aluminum alloy forging according to claim 1, wherein the content of Fe is 0.23 mass % or more and 0.7 mass % or less.

8. The aluminum alloy forging according to claim 1, wherein the content of Ti is 0.012 mass % or more and 0.035 mass % or less.

9. The aluminum alloy forging according to claim 1, wherein the content of Ti is 0.012 mass % or more and 0.025 mass % or less.

10. The aluminum alloy forging according to claim 1, wherein the content of Ti is 0.012 mass % or more and 0.02 mass % or less.

11. The aluminum alloy forging according to claim 1, wherein the content of Cr is 0.03 mass % or more and 0.2 mass % or less.

12. The aluminum alloy forging according to claim 11, wherein the content of Mg is 0.63 mass % or more and 1.25 mass % or less, the content of Si is 0.60 mass % or more and 1.45 mass % or less, and the ratio of the content of Si to the content of Mg, Si/Mg, is 0.5 or more in the molar ratio.

13. The aluminum alloy forging according to claim 11, wherein the content of Mg is 0.85 mass % or more and 1.30 mass % or less, the content of Si is 0.45 mass % or more and 0.69 mass % or less, and the ratio of the content of Si to the content of Mg, Si/Mg, is less than 0.5 in the molar ratio.

14. The aluminum alloy forging according to claim 11, wherein the content of Mn is 0.03 mass % or more and 1.0 mass % or less, the content of Fe is 0.2 mass % or more and 0.7 mass % or less, the content of Ti is 0.012 mass % or more and 0.035 mass % or less, the content of B is 0.001 mass % or more and 0.03 mass % or less, and the content of Zn is 0.25 mass % or less.

15. The aluminum alloy forging according to claim 12, wherein the content of Mn is 0.03 mass % or more and 1.0 mass % or less, the content of Fe is 0.2 mass % or more and 0.7 mass % or less, the content of Ti is 0.012 mass % or more and 0.035 mass % or less, the content of B is 0.001 mass % or more and 0.03 mass % or less, and the content of Zn is 0.25 mass % or less.

16. The aluminum alloy forging according to claim 13, wherein the content of Mn is 0.03 mass % or more and 1.0 mass % or less, the content of Fe is 0.2 mass % or more and 0.7 mass % or less, the content of Ti is 0.012 mass % or more and 0.035 mass % or less, the content of B is 0.001 mass % or more and 0.03 mass % or less, and the content of Zn is 0.25 mass % or less.

17. The aluminum alloy forging according to claim 11, wherein the content of Fe is 0.23 mass % or more and 0.7 mass % or less.

18. The aluminum alloy forging according to claim 11, wherein the content of Ti is 0.012 mass % or more and 0.035 mass % or less.

19. The aluminum alloy forging according to claim 11, wherein the content of Ti is 0.012 mass % or more and 0.025 mass % or less.

20. The aluminum alloy forging according to claim 11, wherein the content of Ti is 0.012 mass % or more and 0.02 mass % or less.

* * * * *